US012024388B2

(12) United States Patent
Lin

(10) Patent No.: US 12,024,388 B2
(45) Date of Patent: Jul. 2, 2024

(54) ONE-PIECE TAPE CUTTING DEVICE

(71) Applicant: Chien-Ting Lin, Santa Fe Springs, CA (US)

(72) Inventor: Chien-Ting Lin, Santa Fe Springs, CA (US)

( * ) Notice: Subject to any disclaimer, the term of this patent is extended or adjusted under 35 U.S.C. 154(b) by 0 days.

(21) Appl. No.: 17/882,664

(22) Filed: Aug. 8, 2022

(65) Prior Publication Data

US 2023/0038807 A1 Feb. 9, 2023

(30) Foreign Application Priority Data

Aug. 9, 2021 (CN) ..... 202121846473.5

(51) Int. Cl.
*B65H 35/00* (2006.01)

(52) U.S. Cl.
CPC ..... *B65H 35/0033* (2013.01); *B65H 35/008* (2013.01)

(58) Field of Classification Search
CPC ..... B65H 35/0033; B65H 35/0006; B65H 35/0026; B65H 35/0073; B65H 35/008
See application file for complete search history.

(56) References Cited

U.S. PATENT DOCUMENTS 5,363,997 A * 11/1994 Harris ..... B65H 35/0026 225/56
5,468,332 A * 11/1995 Dretzka ..... B65H 35/0026 156/577
6,789,594 B1 * 9/2004 Yu Chen ..... B65H 35/0026 225/56
2006/0219748 A1 * 10/2006 Thompson ..... B65H 35/0026 225/16

FOREIGN PATENT DOCUMENTS

CN 107161419 A * 9/2017
DE 202005001510 U1 * 6/2005
EP 3192758 A1 * 7/2012
EP 3192758 A1 * 7/2017
KR 200173218 Y1 * 4/2000
KR 20100090572 A * 8/2010

* cited by examiner

*Primary Examiner* — Jennifer S Matthews
(74) *Attorney, Agent, or Firm* — Lin & Associates Intellectual Property, Inc.

(57) ABSTRACT

A one-piece tape cutting device is provided, comprising: a tape shaft, a tape pressing part, a cutting part, a tape supporting part, a side plate, and a pressing plate, and all are integrally formed without being connected by any fasteners. the tape is sleeved on the outside of the tape shaft from the opposite side of the side plate, the pressing plate is stretched by the tape and away from the tape shaft, so that the tape is pressed by the pressing plate and does not rotate, the tape is restricted by the anti-dislodging piece and does not disengage, and the end of the tape is pulled through the gap between the tape supporting part and the tape pressing part, and non-adhesive surface of the tape faces the tape pressing part, and the cutting part can cut through the tape.

5 Claims, 5 Drawing Sheets

ONE-PIECE TAPE CUTTING DEVICE

CROSS-REFERENCE TO RELATED APPLICATION

This application claims the priority of Chinese patent application No. 202121846473.5, filed on Aug. 9, 2021, which is incorporated herewith by reference.

BACKGROUND OF THE INVENTION

1. Field of the Invention

The present invention relates generally to a tape cutting device, and more particularly, to a one-piece tape cutting device.

2. The Prior Arts

The conventional tape cutting devices come with a variety of structures due to functional requirements or cost requirements. It is common to integrate the pressing plate with the tape pressing part, or integrate the tape shaft with the tape pressing part; however, the integrated parts are still connected with other parts by fasteners, and not all parts are integrated.

Due to the use of fasteners for connection in the conventional tape cutting devices, there is a problem of falling off during use, which affects the function, and the scattered parts may be lost before assembled together again, so as to affect the usage.

SUMMARY OF THE INVENTION

In order to overcome the problems of the conventional tape cutting device, the present invention provides a one-piece tape cutting device, which has a tape shaft, a tape pressing part, a cutting part, a tape supporting part, a side plate, and a pressing plate, and all the components are integrally formed and are not connected by any fasteners. In particular, the pressing plate naturally leans towards the tape shaft and has elasticity, so that the pressing plate can adapt to various thicknesses of tape rolls and solve the problem of missing parts or unsmooth usage in the conventional tape cutting devices.

The technical scheme adopted by the present invention to solve the technical problem is: a one-piece tape cutting device, applicable to pressing and cutting a tape when sealing a box, which is characterized by: a tape shaft; a tape pressing part, the tape pressing part having a pressing surface; a cutting part, disposed at a proper position outside the pressing surface of the tape pressing part, used for cutting-a used for cutting a tape; and a tape supporting part, disposed between the tape shaft and the tape pressing part, and with a preset gap from both the tape shaft and the tape pressing part, used for supporting the tape, so that the end of the tape being kept in the vicinity of the adhesive tape pressing part, and not sticking back; a side plate, for connecting one end of the tape shaft, the tape supporting part and the tape pressing part to each other through the side plate; a pressing plate disposed above the tape pressing part, not directly connected to the side plate, with one end integrally extending from the tape pressing part at an appropriate place toward and above the tape shaft so as to attain elasticity, and the other end leaning toward the tape shaft and being disposed with an anti-dislodging piece at the opposite surface of the side plate, and having an adjustable distance between the pressing plate and the tape shaft; wherein the tape shaft, the tape pressing part, the cutting part, the tape supporting part, the side plate, and the pressing plate are all integrally formed without any fasteners; the tape is sleeved on the outside of the tape shaft from the opposite side of the side plate, the pressing plate is stretched by the tape and away from the tape shaft, so that the tape is pressed by the pressing plate and does not rotate, the tape is restricted by the anti-dislodging piece and does not disengage, and the end of the tape is pulled through the gap between the tape supporting part and the tape pressing part, and non-adhesive surface of the tape faces the tape pressing part, and the cutting part can cut through the tape.

Preferably, the pressing surface is an arc surface or a conical surface.

Preferably, the tape supporting part has a reverse-hook shape.

Preferably, an elastic piece is disposed outside the tape shaft.

Preferably, the tape supporting part has a lateral length greater than a half of a lateral width of the pressing surface, and the gap between the pressing surface and the tape supporting part has a minimum distance 1-2 mm to more effectively prevent the tape from sticking back.

The beneficial effect of the present invention is that the present invention can avoid the problem that the missing parts or unsmooth usage of the conventional tape cutting device, and the monolithic molding can greatly reduce the cost and increase the stability of use.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
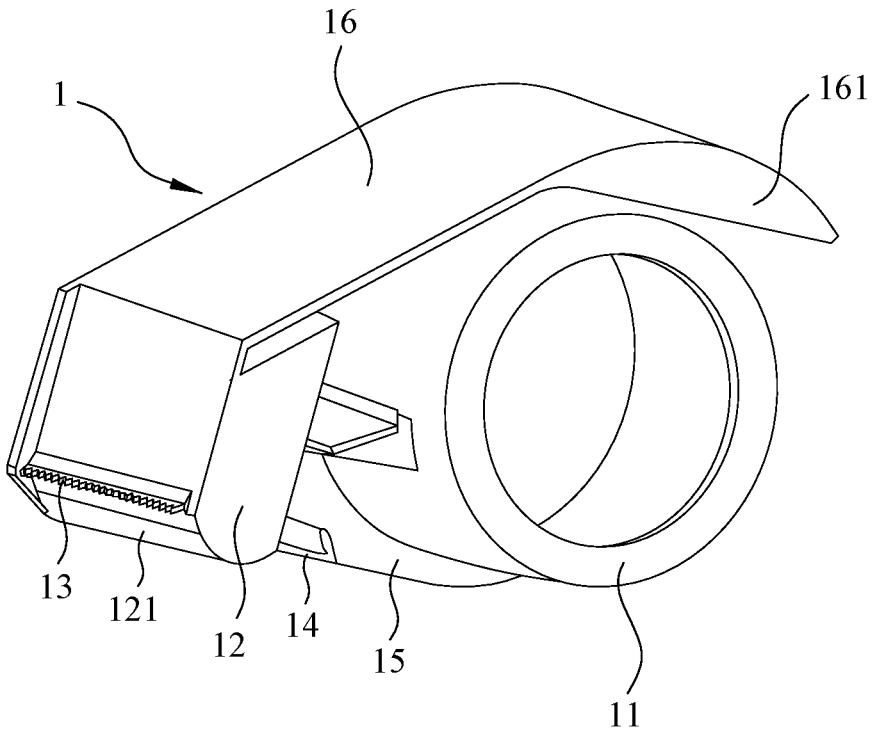
FIG. 1 is a schematic view of a first embodiment of the present invention.
Figure 2:
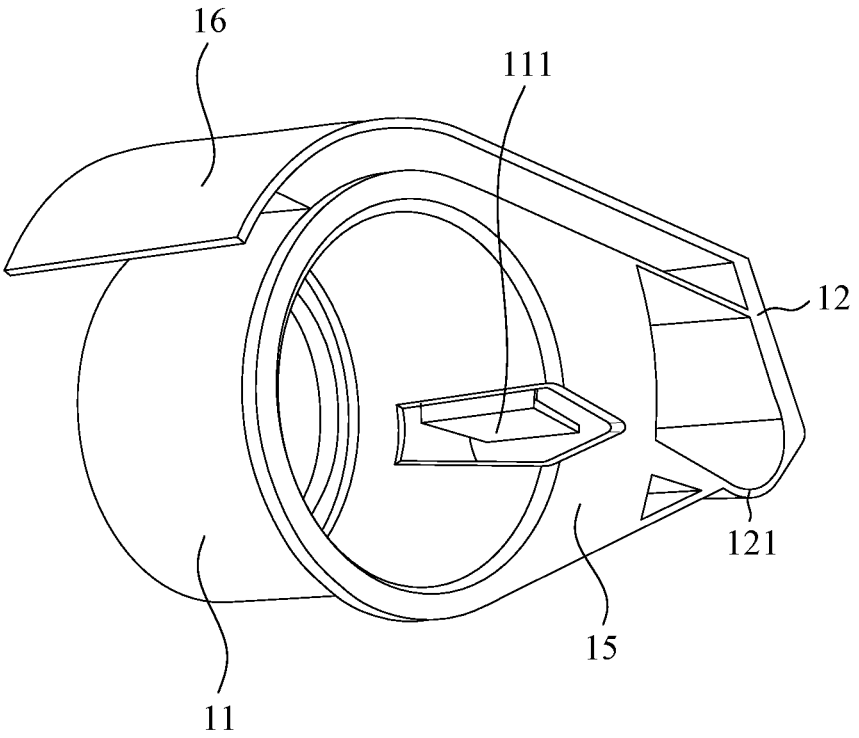
FIG. 2 is a schematic view of another angle of the first embodiment of the present invention.

The accompanying drawings are included to provide a further understanding of the invention, and are incorporated in and constitute a part of this specification. The drawings illustrate embodiments of the invention and, together with the description, serve to explain the principles of the invention.

Embodiments of the present invention will be described below with reference to FIGS. 1 to 5. The following description is not intended to limit the embodiments of the present invention, but is an example of the present invention.

As shown in FIGS. 1 to 5, a one-piece tape cutting device of the first embodiment of the present invention is used for pressing and cutting a tape 2 when sealing a box, including: a tape shaft 11; a tape pressing part 12, the tape pressing part 12 has a pressing surface 121; a cutting part 13, the cutting part 13 is used for cutting the tape 2, and is disposed at a proper position on the outer side of the pressing surface 121 of the pressing part 12; a tape supporting part 14, the tape supporting part 14 is disposed between the tape shaft 11 and the tape pressing part 12, and separated from both with a preset gap; the tape supporting part 14 is used to support the tape 2, so that the end 21 of the tape 2 is kept near the tape pressing part 12 and will not stick back to the tape 2; a side plate 15, wherein one of each of the tape shaft 11, the tape supporting part 14 and the tape pressing part 12 are connected to each other through the side plate 15; and a pressing plate 16, the pressing plate is disposed above the tape pressing part 12 but not directly connected to the side plate 15, one end of the pressing plate 16 integrally extends from the tape pressing part 12 at a proper position toward and above the tape shaft 11 so as to attain elasticity, the other end of the pressing plate 16 leans toward the tape shaft 11, an anti-dislodging piece is disposed at the opposite surface of the side plate 15, and the distance between the pressing plate 16 and the tape shaft 11 is adjustable; wherein, the tape shaft 11, the tape pressing part 12, the cutting part 13, the tape supporting part 14, the side plate 15, and the pressing plate 16 are all integrally formed without any fasteners; the tape 2 is sleeved on the outer side of the tape 11 from the opposite side of the side plate 15, the pressing plate 16 is stretched by the tape 2 and away from the tape shaft 11, so that the tape 2 is pressed by the pressing plate 16 and does not rotate, the tape 2 is restricted by the anti-dislodging piece 161 and does not disengage, and the end 21 of the tape 2 is pulled through the gap between the tape supporting part 14 and the tape pressing part 12, and the non-adhesive surface of the tape 2 faces the tape pressing part 12, and the cutting part can cut through the tape 2. The present invention is to manufacture the tape cutting device into one-piece, without any assembly problems and assembly cost. By utilizing the natural elasticity of the pressing plate 16, the pressing plate 16 is naturally abutted towards the tape shaft 11. When the tape 2 is placed, the elasticity of the pressing plate 16 will naturally hold the tape 2. When the end 21 of the tape 2 is pulled, the elasticity of the pressing board 16 causes the pressing plate 16 to be repeatedly bounced and pressed by the tape 2. Therefore, the tape 2 can move smoothly, and the pressing plate 16 can effectively work with the rotation, pressing and holding the tape 2. When cutting the tape 2, the pressing plate 16 is pressed to stop the rotation of the tape 2, and the anti-dislodging piece 161 restricts the tape 2 to the outer side of the tape 2 without disengagement.

As shown in FIG. 1, the pressing surface 121 of the first embodiment of the present invention is an arc-shaped surface, so that in the process of rolling the tape 2, that is, the process of sticking the tape 2 to the object, the tape 2 is more easily attached to the object by the pressing of the pressing surface 121, and the rolling of the tape 2 is smoother. The pressing surface 121 in the present embodiment is mainly used to press and stick the tape 2 to the object, so that the attachment of the tape 2 and the object is tighter. Therefore, other shapes of the pressing surface 121 that can achieve this purpose can also be used, such as conical surfaces, etc.

Figure 3:
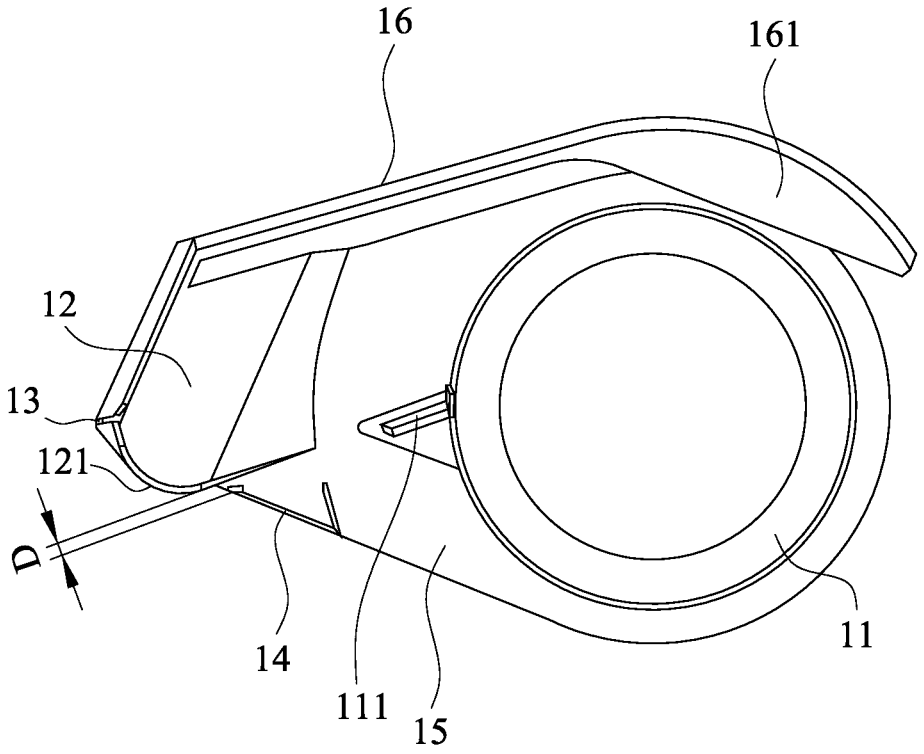
FIG. 3 is a schematic view of a third angle of the first embodiment of the present invention.
Figure 5:
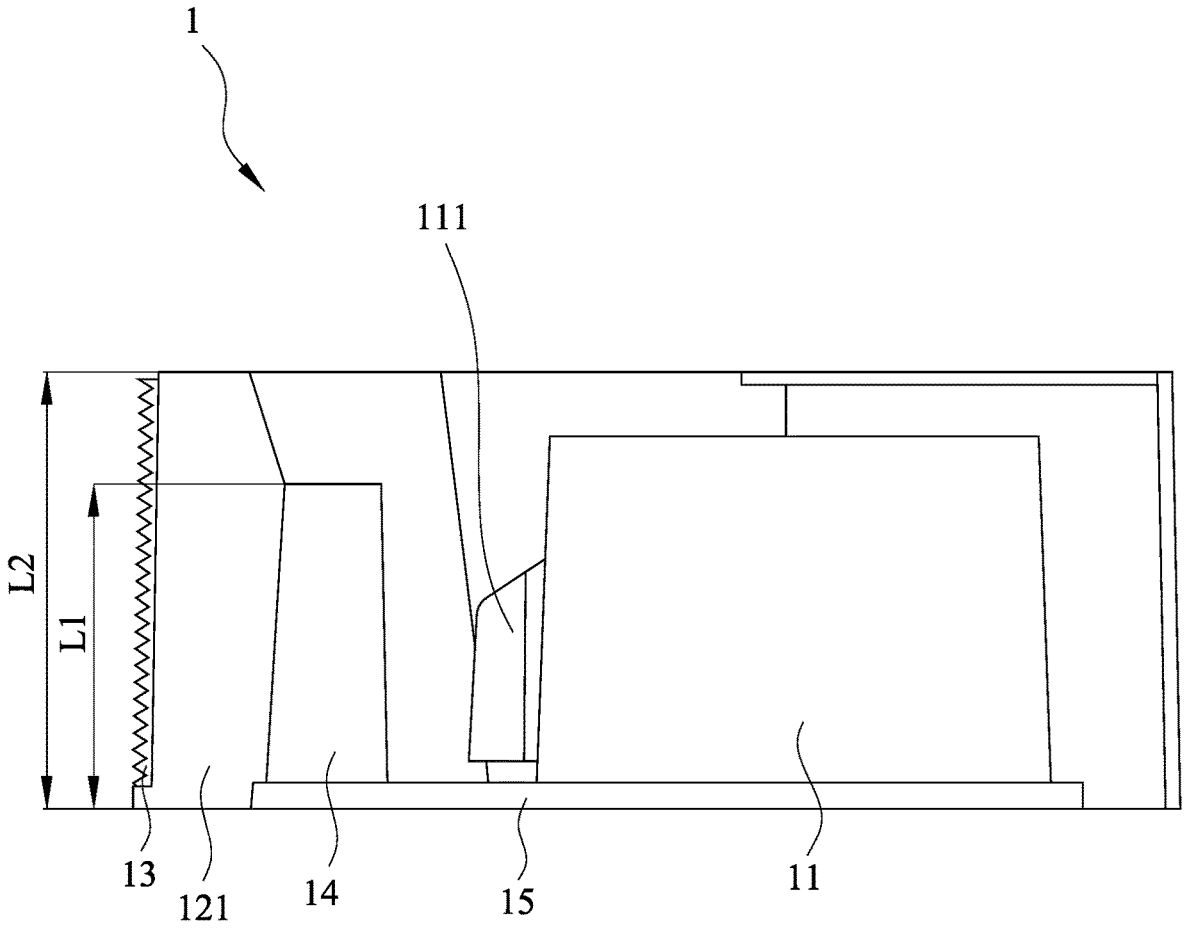
FIG. 5 is a schematic view of a fourth angle of the first embodiment of the present invention.

As shown in FIG. 3, the tape supporting part 14 according to the first embodiment of the present invention is in the shape of a reverse-hook. After the tape 2 is cut by the cutting part 13, contact of the tape 2 and the tape supporting part 14 is at the end of the reverse-hook, which is mainly to maintain the supporting of the tape 2, and to minimize the contact surface with the tape 2. The tape supporting part 14 in the present embodiment is in the shape of a reverse-hook, with the end near the tape pressing part 12 longer, and the end near the tape shaft 11 short. In practical applications, the gap between the tape supporting part 14 and the tape pressing part 12 is controlled to be the minimum distance that allows the tape 2 to pass through and slide smoothly. The best condition is that after the tape 2 is cut by the cutting part 13, only the long end of the reverse-hook of the tape supporting part 14 in contact with the tape 2, and the short end is reserved as backup. In general, the tape 2 will not be in contact with the tape supporting part 14 when in the rolling process. Preferably, as shown in FIG. 5, the tape supporting part 14 has a lateral length L1 greater than a half of a lateral width L2 of the pressing surface 121, and the gap D between the pressing surface 121 and the tape supporting part 14 has a minimum distance 1-2 mm to more effectively prevent the tape from sticking back.

Figure 4:
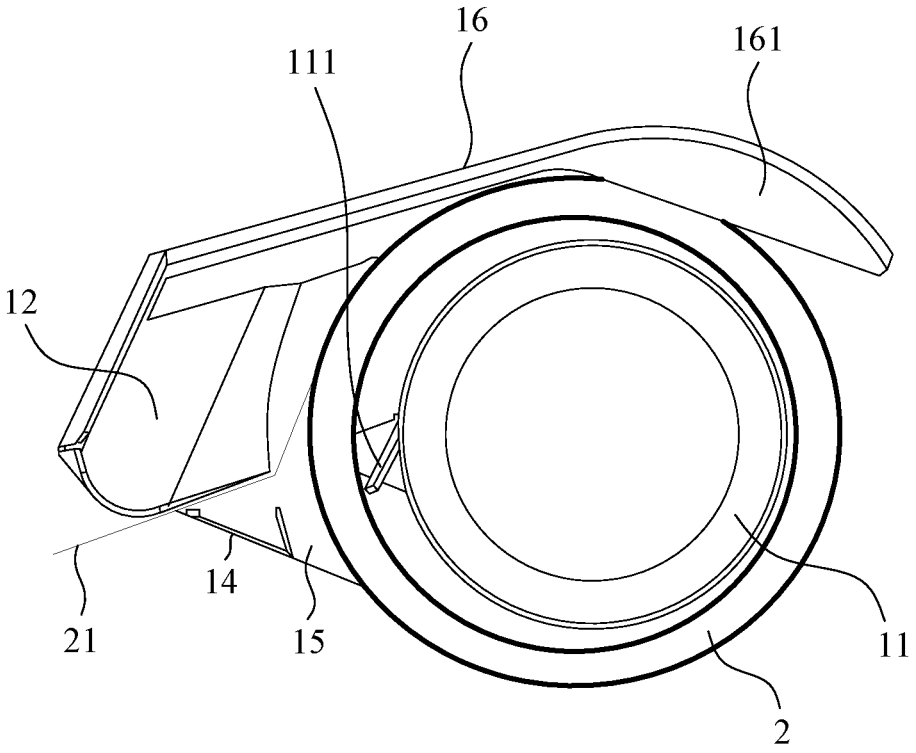
FIG. 4 is a schematic view of the third angle of the first embodiment of the present invention with tape installed.

As shown in FIG. 4, the tape shaft 11 of the first embodiment of the present invention is provided with an elastic piece 111 outward, and the elastic piece 111 can adapt to the tape 2 of various inner diameters to increase the relative fixing force between the shaft 11 and the tape. The. The elastic piece 111 in the present embodiment is a small square piece that is arranged along an appropriate direction on outer side the tape shaft 11, and the small square piece can be integrated with the tape shaft. In addition, the elastic piece 111 can be an independent piece and then connected to the on the tape shaft 11.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A one-piece tape cutting device, applicable to pressing and cutting a tape when sealing a box, comprising:

a tape shaft;

a tape pressing part having a pressing surface;

a cutting part, disposed at a proper position outside the pressing surface of the tape pressing part for cutting the tape;

a tape supporting part, disposed between the tape shaft and the tape pressing part for supporting the tape, wherein a gap is formed between the tape pressing part and the tape supporting part so that an end of the tape is located near the tape pressing part;

a side plate, for connecting the tape shaft, the tape supporting part and the tape pressing part to each other at a respective end thereof; and a pressing plate having elasticity integrally extends from the tape pressing part toward and above the tape shaft and is positioned above the tape pressing part, the tape supporting part, the tape shaft and the side plate, a distal end of the pressing plate angled oblique toward the tape shaft with an anti-dislodging piece at a side thereof opposite to the side plate, the elasticity of the pressing plate is configured for adjusting a distance between the pressing plate and the tape shaft;

wherein the tape shaft, the tape pressing part, the cutting part, the tape supporting part, the side plate, and the pressing plate are all integral without any fasteners;

wherein, the tape is sleeved on an outside of the tape shaft from an opposite side of the side plate, the pressing plate is stretched by the tape and away from the tape shaft, so that the tape is pressed by the pressing plate, the tape is restricted by the anti-dislodging piece and thus does not disengage from the tape shaft, and the end of the tape is pulled through the gap between the tape supporting part and the tape pressing part, a non-adhesive surface of the tape faces the tape pressing part, and the cutting part can cut through the tape.

2. The one-piece tape cutting device according to claim 1, wherein the pressing surface is an arc surface or a conical surface.

3. The one-piece tape cutting device according to claim 1, wherein the tape supporting part has a reverse-hook shape.

4. The one-piece tape cutting device according to claim 1, wherein an elastic piece is disposed on an outer side of the tape shaft.

5. The one-piece tape cutting device according to claim 1, wherein the tape supporting part has a lateral length greater than a half of a lateral width of the pressing surface, and the gap between the tape pressing part and the tape supporting part has a minimum distance 1-2 mm to prevent the tape from sticking back.

* * * * *